US007735157B2

(12) United States Patent
Ikeda

(10) Patent No.: US 7,735,157 B2
(45) Date of Patent: Jun. 15, 2010

(54) FULL-FACE-TYPE HELMET

(75) Inventor: Yoshiyuki Ikeda, Toyko (JP)

(73) Assignee: Shoei Co., Ltd. (JP)

( * ) Notice: Subject to any disclaimer, the term of this patent is extended or adjusted under 35 U.S.C. 154(b) by 1005 days.

(21) Appl. No.: 11/486,464

(22) Filed: Jul. 14, 2006

(65) Prior Publication Data

US 2007/0011797 A1 Jan. 18, 2007

(30) Foreign Application Priority Data

Jul. 15, 2005 (JP) ..... 2005-206859

(51) Int. Cl.
*A42B 1/06* (2006.01)
*A42B 1/08* (2006.01)
*A63B 71/10* (2006.01)

(52) U.S. Cl. ..... 2/410; 2/424; 2/425

(58) Field of Classification Search ..... 2/410, 2/411, 414, 422, 423, 424, 425, 9, 184.5
See application file for complete search history.

(56) References Cited

U.S. PATENT DOCUMENTS 4,555,816 A 12/1985 Broersma
4,627,115 A 12/1986 Broersma
6,289,521 B1 * 9/2001 Ikeda ..... 2/421
2007/0250991 A1 * 11/2007 Pierce ..... 2/414

FOREIGN PATENT DOCUMENTS

DE 3332577 A1 3/1985
DE 3419302 A1 11/1985

* cited by examiner

*Primary Examiner*—Gary L Welch
*Assistant Examiner*—Amber R Anderson
(74) *Attorney, Agent, or Firm*—Jones Day

(57) ABSTRACT

A full-face-type helmet such as an off-road driving helmet, in which ventilation of the interior of the full-face-type helmet is performed well by external air flowing in from a chin region, and a ventilation through hole extending through an impact absorbing liner substantially in the direction of its thickness need not be particularly formed in a region including the side head region and its vicinity of the impact absorbing liner for the external air flowing in from the chin region. The impact-on-the-chin absorbing portion of the impact absorbing liner disposed inside an outer shell having a first ventilation opening in the chin region includes a liner main body portion, and a sheet-like backing plate which is arranged on the inner surface of the liner main body portion. The liner main body portion includes a second ventilation opening substantially opposing the first ventilation opening, and a ventilation ridge groove which is formed in the inner surface of the liner main body portion and communicates with the second ventilation opening.

7 Claims, 4 Drawing Sheets

FULL-FACE-TYPE HELMET

TECHNICAL FIELD

The present invention relates to a full-face-type helmet comprising an outer shell having a ventilation opening in a chin region substantially opposing the chin of a helmet wearer (to be referred to as a "wearer" hereinafter) such as the rider of a motorcycle, and an impact absorbing liner disposed inside the outer shell. The present invention also relates to a full-face-type helmet comprising an outer shell having a ventilation opening in a chin region substantially opposing the chin of the wearer, an impact-on-the-chin-and-cheek absorbing liner disposed inside the outer shell, and a blockish inside pad for the cheek attached to the inner surface of the impact-on-the-chin-and-cheek absorbing liner. The present invention is optimally applied to an off-road driving full-face-type helmet such as a motocross helmet.

BACKGROUND OF THE INVENTION

In off-road driving such as motocross, when running through an unlevel land, the rider may receive large vibration through the motorcycle or take a large action to maintain the balance of the motorcycle, and hence the amount of exercise of the rider is large. Therefore, conditions that should be considered by the rider when selecting a helmet include being lightweight, facilitating breathing, providing a large view, ensuring coolness, and the like.

As a helmet that satisfies the above conditions, conventionally, a so-called jet-type helmet through which the rider's face is open largely is used. With the jet-type helmet, however, it is difficult to protect the rider's chin effectively. Hence, as the helmet manufacturing technique improved afterwards, a full-face-type helmet which is lightweight, facilitates breathing and provides a large view, thus suitable for off-road driving of, e.g., a motocross has appeared. Such an off-road driving full-face-type helmet is disclosed in, e.g., U.S. Pat. No. 4,555,816.

The off-road driving full-face-type helmet disclosed in U.S. Pat. No. 4,555,816 comprises a large opening at the center of the chin cover to supply external air to near the wearer's mouth. In the helmet of U.S. Pat. No. 4,555,816, in order to introduce external air to the wearer's head as well, small openings for introducing external air into the head cover are provided to the left and right sides, respectively, of the large opening described above.

Furthermore, in the full-face-type helmet of U.S. Pat. No. 4,555,816, air passages to relatively move the external air from the small openings in the chin cover to inside the head cover are formed between an outer shall integrally molded of the chin cover and head cover, and an impact-on-the-chin absorbing liner for the chin cover and an impact-on-the-head absorbing liner for the head cover. More specifically, ventilation ridge grooves are formed in the outer surfaces of the impact-on-the-chin absorbing liner and impact-on-the-head absorbing liner, respectively, to substantially communicate with each other, thereby forming the air passage comprising the ventilation ridge grooves and the outer shell disposed outside them.

In the full-face-type helmet of U.S. Pat. No. 4,555,816 having the above arrangement, an external air introducing through hole extending through the impact-on-the-head absorbing liner in the direction of thickness must be formed near the side head region of the impact-on-the-head absorbing liner in order to introduce external air into the interior of the impact-on-the-head absorbing liner (that is, a head accommodating space of the helmet) through the terminal end portion of the air passage. Also, the air passage as described above is formed to introduce external air into the head cover through small openings formed in the chin cover. In the air passage, external air that has flown for a comparatively long distance along the ventilation ridge grooves formed in the outer surfaces of the impact-on-the-chin absorbing liner and impact-on-the-head absorbing liner, respectively, must bend substantially at a right angle at the through hole. As the resistance against the external air flow is large, the external air cannot flow well from the small openings formed in the chin cover into the head cover.

Hence, in the full-face-type helmet of U.S. Pat. No. 4,555,816, ventilation in the full-face-type helmet is not performed well unless the driving speed of the motorcycle is maintained at a certain degree. In the driving state wherein the driving speed is comparatively low and the amount of exercise of the rider is comparatively large, as in a case wherein the rider runs through an unlevel land on a motorcycle, ventilation of the interior of the full-face-type helmet is not performed well. Consequently, vapor generated by perspiration of the rider's head fills the interior of the full-face-type helmet to increase the unpleasantness of the rider as the wearer.

In the full-face-type helmet of U.S. Pat. No. 4,555,816, the impact-on-the-head absorbing liner must moderate the impact acting on the helmet by absorbing it while deforming. If the through hole extending through the impact-on-the-head absorbing liner in the direction of the thickness is formed near the side head region of the impact-on-the-head absorbing liner, the performance of moderating the impact may degrade near the side head region of the impact-on-the-head absorbing liner provided with the through hole. Hence, the through hole extending through the impact-on-the-head absorbing liner in the direction of thickness is largely restricted in its size and position.

Hence, according to the present invention, the defects as described above of the conventional full-face-type helmet such as an off-road driving helmet can be corrected effectively with a comparatively simple arrangement.

SUMMARY OF THE INVENTION

It is, therefore, the main object of the present invention to provide a full-face-type helmet such as an off-road driving helmet, in which ventilation of the interior of the full-face-type helmet is performed well by external air flowing in from a chin region, and a ventilation through hole extending through an impact absorbing liner substantially in the direction of its thickness need not be particularly formed in a region including the side head region and its vicinity of the impact absorbing liner for the external air flowing in from the chin region.

According to the first aspect of the present invention, there is provided a full-face-type helmet comprising an outer shell having a first ventilation opening in a chin region substantially opposing the chin of a wearer, and an impact absorbing liner disposed inside the outer shell. The impact absorbing liner has an impact-on-the-chin absorbing portion comprising a liner main body portion and a sheet-like backing plate which is arranged on an inner surface of the liner main body portion. The liner main body portion comprises a second ventilation opening substantially opposing the first ventilation opening, and a ventilation ridge groove which is formed in the inner surface of the liner main body portion and communicates with the second ventilation opening. In this case, the impact-on-the-chin absorbing portion can comprise an impact-on-the-chin absorbing portion of an impact-on-the-chin-and-cheek absorbing liner.

According to the second aspect of the present invention, there is provided a full-face-type helmet comprising an outer shell having a first ventilation opening in a chin region substantially opposing the chin of a wearer, an impact-on-the-chin-and-cheek absorbing liner disposed inside the outer shell, and a blockish inside pad for the cheek which is attached to the inner surface of the impact-on-the-chin-and-cheek absorbing liner. The impact-on-the-chin-and-cheek absorbing liner comprises a liner main body portion and a sheet-like backing plate (in other words, a pad attaching plate) which is arranged on an inner surface of the liner main body portion and to which the blockish inside pad for the cheek is attached. The liner main body portion comprises a second ventilation opening substantially opposing the first ventilation opening, and a ventilation ridge groove which is formed in the inner surface of the liner main body portion and communicates with the second ventilation opening.

According to either one of the first and second aspects of the present invention, unlike in the case of a conventional full-face-type helmet such as an off-road driving helmet, after external air has flown for a comparatively long distance along ventilation ridge grooves respectively formed in the outer surfaces of the impact-on-the-chin absorbing liner and impact-on-the-head absorbing liner, the external air need not bend substantially at a right angle at a through hole. Therefore, after being introduced into the outer shell from the first ventilation opening formed in the chin region of the outer shell, the external air can immediately bend to flow into the start end portions of the ventilation ridge groove formed in the inner surface of the liner main body portion of the impact absorbing liner. External air inflow to the start end portion of the ventilation ridge groove and external air outflow from the terminal end portion of the ventilation ridge groove can accordingly be performed comparatively well. Thus, ventilation of the interior of the full-face-type helmet can be performed well by the external air inflow from the chin region.

According to either one of the first and second aspects of the present invention, unlike in the case of a conventional full-face-type helmet such as an off-road driving helmet, a ventilation through hole need not be formed in a region including the side head region and its vicinity of the impact-on-the-head absorbing liner to extend substantially in the direction of thickness of the impact-on-the-head absorbing liner. Therefore, unlike in a case wherein such a ventilation through hole must be formed, limitations on the size and position of the ventilation through hole are not imposed on the present invention.

According to the second aspect of the present invention, the sheet-like backing plate to which the blockish inside pad for the cheek is attached can cover the ventilation ridge groove formed in the inner surface of the liner main body portion. Therefore, a full-face-type helmet, ventilation of the interior of which can be performed well and in which a ventilation through hole need not be particularly formed in the region including the side head part and its vicinity of the impact absorbing liner, can be provided with a comparatively simple arrangement.

According to either one of the first and second aspects of the present invention, the sheet-like backing plate preferably comprises a third ventilation opening substantially opposing the second ventilation opening. In this case, part of the external air that has passed through the first and second ventilation openings in the chin region of the full-face-type helmet flows into a region including the wearer's mouth and its vicinity through the third ventilation opening. According to either one of the first and second aspects of the present invention, the sheet-like backing plate preferably comprises a projection (preferably, a substantially ring-like projection) which is formed of at least part of the peripheral portion (preferably, substantially the entire peripheral portion) of the third ventilation opening and faces the second ventilation opening. In this case, the flowing direction of another part of the external air is changed by the projection of the sheet-like backing plate so the external air shifts toward the ventilation ridge groove. The projection thus serves as a deflector or baffle against the external air flow. Therefore, in either case, ventilation of the interior of the full-face-type helmet can be performed further well with a comparatively simple arrangement.

According to the present invention, the sheet-like backing plate may comprise a pair of left and right sheet-like backing plates and a substantially central sheet-like backing plate interposed between the pair of left and right sheet-like backing plates, and the third ventilation opening may be formed in the substantially central sheet-like backing plate. In this case, the projection can be formed on the substantially central sheet-like backing plate.

According to the present invention, a liner main body portion of the impact-on-the-chin-and-cheek absorbing liner may comprise a pair of left and right liner main body portions, and the second ventilation opening may be formed by abutting a first missing portion formed in the left liner main body portion and a second missing portion formed in the right liner main body portion to be in a substantially abutting state. According to the present invention, an average thickness of the sheet-like backing plate may fall within a range of 0.25 mm to 4 mm, preferably within a range of 0.5 mm to 2 mm, and more preferably within a range of 0.75 mm to 1.4 mm.

According to the present invention, the ventilation ridge groove may have a start end facing the second ventilation opening and a terminal end which is formed in an end face of the liner main body portion in a region including an upper end portion and its vicinity of the liner main body portion. In this case, the ventilation ridge groove can extend from the start end substantially backward, bend substantially upward substantially arcuately, then extend substantially upward and reach the terminal end which is present in a region including a side head region and its vicinity of the impact-on-the-chin-and-cheek absorbing liner substantially opposing a side head part of the helmet wearer.

According to the present invention, the ventilation ridge groove is preferably covered with the sheet-like backing plate. According to the present invention, the ventilation ridge groove may gradually widen, at a start end portion thereof which faces the second ventilation opening, substantially into a trumpet shape, when seen from the front, from a terminal end side thereof toward the start end. Furthermore, according to the present invention, the ventilation ridge groove may gradually widen, at a terminal end portion thereof opposite to the start end portion thereof which faces the second ventilation opening, substantially into a trumpet shape, when seen from the front, from a start end side thereof toward said terminal end.

According to the present invention, an average width of a main part of the ventilation ridge groove (when the start end portion and/or a terminal end portion thereof forms a trumpet-shaped portion, the trumpet-shaped portion is excluded) may fall within a range of 4 mm to 16 mm and preferably within a range of 6 mm to 11 mm. According to the present invention, an average depth of a main part of the ventilation ridge groove (when the start end portion and/or a terminal end portion thereof forms a trumpet-shaped portion, the trumpet-shaped portion is excluded) may fall within a range of 2 mm to 8 mm and preferably within a range of 3 mm to 5.5 mm. Furthermore, according to the present invention, an average sectional area of a main part of the ventilation ridge groove (when the start end portion and/or a terminal end portion thereof forms a trumpet-shaped portion, the trumpet-shaped portion is excluded) may fall within a range of 8 $mm^2$ to 80 $mm^2$ and preferably within a range of 12 $mm^2$ to 40 $mm^2$.

According to the present invention, an area of the third ventilation opening (when the third ventilation opening comprises a plurality of ventilation openings, a total area thereof) may fall within a range of 3 $cm^2$ to 40 $cm^2$ and preferably within a range of 6 $cm^2$ to 20 $cm^2$. According to the present invention, an area of the second ventilation opening (when the second ventilation opening comprises a plurality of ventilation openings, a total area thereof) in an outer surface of the liner main body portion may fall within a range of 8 $cm^2$ to 100 $cm^2$ and preferably within a range of 16 $cm^2$ to 46 $cm^2$. According to the present invention, an area of the second ventilation opening (when the second ventilation opening comprises a plurality of ventilation openings, a total area thereof) in an inner surface of the liner main body portion may fall within a range of 6 $cm^2$ to 80 $cm^2$ and preferably within a range of 12 $cm^2$ to 38 $cm^2$. According to the present invention, a value obtained by subtracting an area of the second ventilation opening (when the second ventilation opening comprises a plurality of second ventilation openings, a total thereof) in an inner surface of the liner main body portion from an area of the second ventilation opening (when the second ventilation opening comprises a plurality of second ventilation openings, a total thereof) in an outer surface of the liner main body portion may fall within a range of 2 $cm^2$ to 20 $cm^2$ and preferably within a range of 4 cm to 8 $cm^2$. Furthermore, according to the present invention, a value obtained by subtracting an area of the third ventilation opening (when the third ventilation opening comprises a plurality of third ventilation openings, a total thereof) from an area of the second ventilation opening (when the second ventilation opening comprises a plurality of second ventilation openings, a total thereof) in an inner surface of the liner main body portion may fall within a range of 3 $cm^2$ to 40 $cm^2$ and preferably within a range of 6 $cm^2$ to 18 $cm^2$.

The above, and other, objects, features and advantages of this invention will become readily apparent from the following detailed description thereof which is to be read in connection with the accompanying drawings.

DETAILED DESCRIPTION OF THE INVENTION

An embodiment obtained by applying the present invention to an off-road driving full-face-type helmet will be described in "(1) Schematic Description of Helmet as a Whole" and "(2) Specific Description of Ventilation System" with reference to the accompanying drawings.

(1) Schematic Description of Helmet as a Whole

Figure 1:
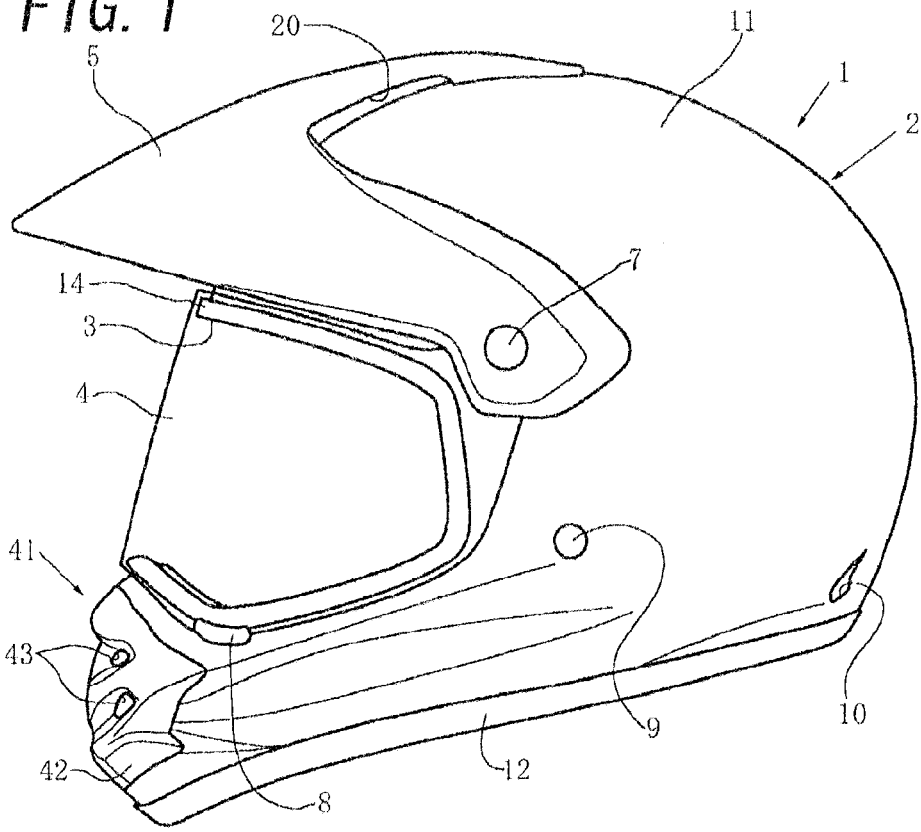
FIG. 1 is a schematic side view of an overall helmet, seen from the right side, of an embodiment in which the present invention is applied to an off-road driving full-face-type helmet.
Figure 2:
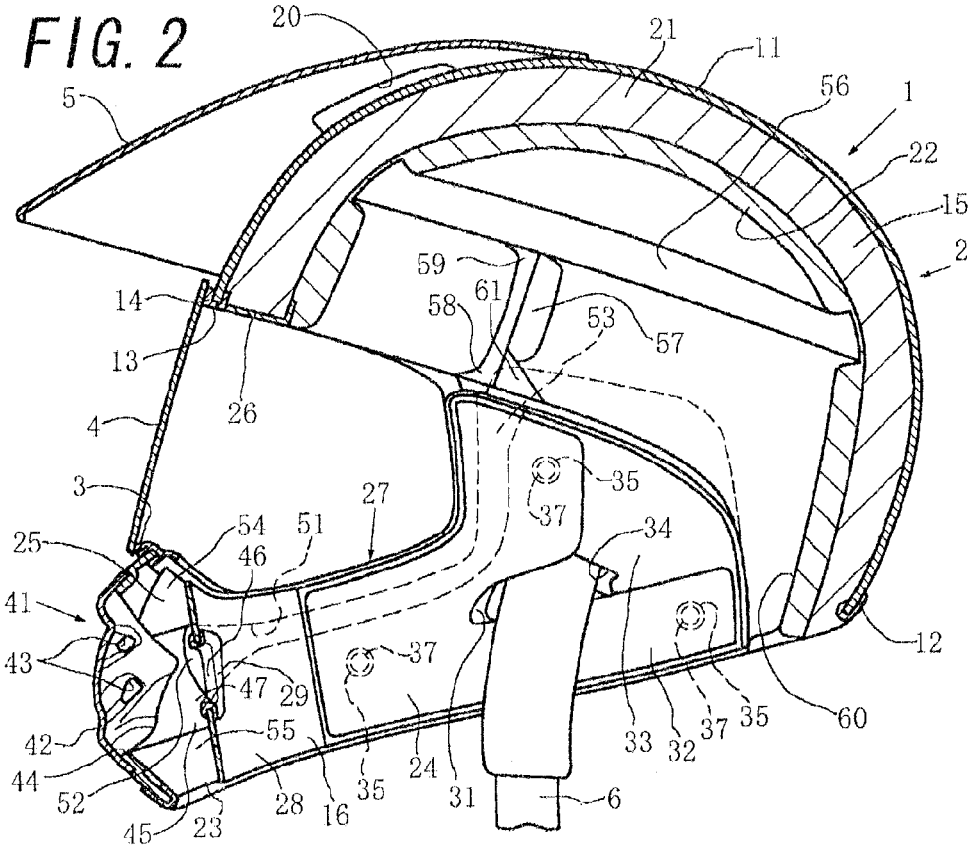
FIG. 2 is a central longitudinal sectional view of the helmet shown in FIG. 1.
Figure 3:
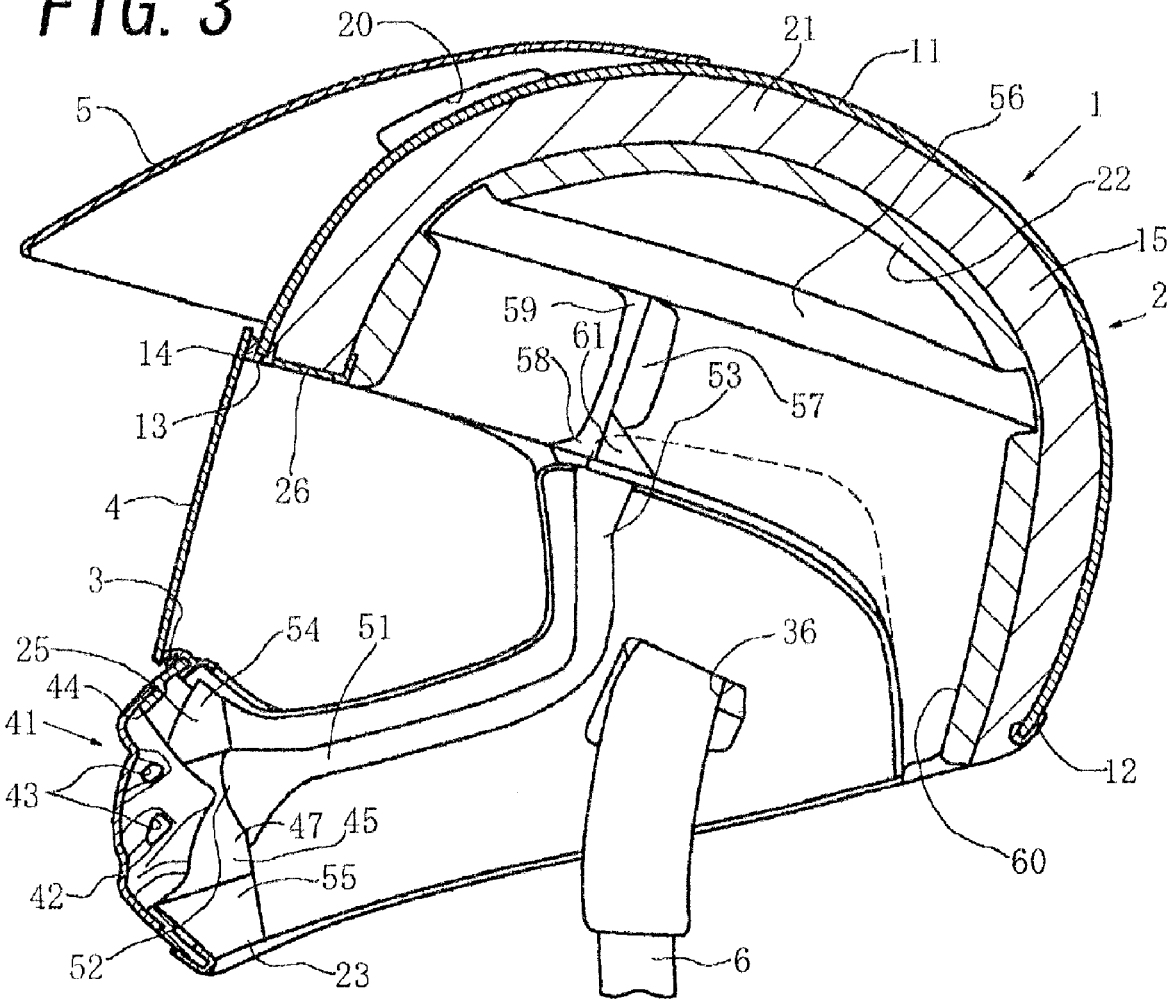
FIG. 3 is a central longitudinal sectional view, similar to that shown in FIG. 2, of the helmet from which a blockish inside pad for the right cheek and a sheet-like backing plate are omitted.

As shown in FIGS. 1 to 3, an off-road driving full-face-type helmet 1 such as a motocross helmet includes a full-face-type cap-like head protecting body 2 to be worn on the head of a wearer, a shield plate 4 which can open/close a window opening 3 formed in the front surface of the head protecting body 2 to oppose a portion (i.e., the face) between the forehead and chin of the wearer, a visor 5 which projects forward above the window opening 3 from the head protecting body 2, and a pair of left and right chin straps 6 attached to the inside of the head protecting body 2. As has been known, the shield plate 4 is made of a transparent or translucent hard material such as polycarbonate or another hard synthetic resin, and pivotally attached to the head protecting body 2 with a pair of left and right attaching screws 7. As has been known, the visor 5 is made of an opaque, translucent or transparent soft material such as polyethylene or another soft synthetic resin, and attached and fixed to the head protecting body 2 with the pair of left and right attaching screws 7 which attach the shield plate 4. Reference numeral 20 denotes a pair of left and right ventilation openings formed between the visor 5 and head protecting body 2.

The shield plate 4 closes the window opening 3 when located at the backward pivoting position shown in FIGS. 1 to 3, and opens the window opening 3 at the forward pivoting position where the shield plate 4 reaches by pivoting upward from the backward pivoting position. At the intermediate position between the two positions, the shield plate 4 can partly open the window opening 3. In FIG. 1, reference numeral 8 denotes a tap provided to the shield plate 4. The tap 8 is held by the wearer with his or her fingers when he or she is to pivot upward and downward the shield plate 4 forward and backward. Reference numeral 9 denotes a rivet to attach and fix the corresponding chin strap 6 to the head protecting body 2. Reference numeral 10 denotes a vent hole to exhaust air in an outer shell 11 externally.

As shown in FIGS. 1 to 3, the head protecting body 2 includes the full-face-type outer shell 11 which forms the circumferential wall of the head protecting body 2, a lower rim member 12 which has a substantially U-shaped section and is attached to the outer shell 11 throughout substantially the entire periphery of the lower end of the outer shell 11 by adhesion with an adhesive or a double-sided tape, or the like, a window opening rim member 14 which has a substantially E-shaped section and is attached to a window opening 13, formed in the outer shell 11 to form the window opening 3 of the head protecting body 2, throughout substantially the entire periphery of the window opening 13 by adhesion with an adhesive or a double-sided tape, or the like, a head backing member 15 which is attached inside the outer shell 11 by adhesion with an adhesive, a double-sided tape, or the like in contact with the inner surface of the outer shell 11 in a front head region, a vertex region, left and right side head regions and a back head region substantially respectively opposing to the front part, vertex, left and right parts and back part of the head of the wearer, and a backing member 16 for the chin and cheek, which is attached inside the outer shell 11 by adhesion with an adhesive or a double-sided tape, or the like in contact with the inner surface of the outer shell 11 in a chin region and cheek region substantially respectively opposing the chin and cheek of the wearer. In FIG. 1, the window opening rim member 14 is seen externally through the transparent shield plate 4.

As has been known, the outer shell 11 shown in FIG. 1 can be made of a composite material formed by lining the inner surface of a strong shell main body made of a hard material, e.g., FRP or another hard synthetic resin with a flexible sheet such as porous unwoven fabric. As has been known, the lower rim member 12 can be made of a soft material, e.g., foamed vinyl chloride, synthetic rubber, or another soft synthetic resin. As has been known, the window opening rim member 14 can be made of a highly flexible elastic material such as synthetic rubber.

As shown in FIGS. 2 and 3, the backing member 15 for the head includes an impact-on-the-head absorbing liner 21 and a permeable backing cover 22 for the head which is attached to the impact-on-the-head absorbing liner 21 to cover substantially the entire inner surface of the impact-on-the-head absorbing liner 21. The backing member 16 for the chin and cheek includes an impact-on-the-chin-and-cheek absorbing liner 23 which substantially forms an arc when seen from the top, and a pair of left and right blockish inside pads 24 for the cheeks which are attached to the impact-on-the-chin-and-cheek absorbing liner 23 in contact with the inner surface of the liner 23 in left and right cheek regions respectively opposing the two, left and right cheeks of the wearer. The impact-on-the-chin-and-cheek absorbing liner 23 comprises a pair of left and right liner main body portions 25 which are substantially abutted against each other to be in a substantially abutting state on the inner surface at substantially the center portion of the front surface of the outer shell 11, and a sheet-like backing plate 27 which is substantially arcuate when seen from the top and attached to substantially throughout the entire inner surfaces of the pair of left and right liner main body portions 25 by adhesion with an adhesive or a double-sided tape, or the like.

The sheet-like backing plate 27 which is substantially arcuate when seen from the top includes three pieces, i.e., a pair of left and right sheet-like backing plates 33 and a substantially central sheet-like backing plate 28 which is present between the pair of left and right sheet-like backing plates 33. The left sheet-like backing plate 33, substantially central sheet-like backing plate 28 and right sheet-like backing plate 33 are sequentially and substantially abutted against each other to be in a substantially abutting state on the inner surfaces of the pair of left and right liner main body portions 25, and accordingly cover substantially the entire inner side surfaces of the pair of left and right liner main body portions 25 substantially arcuately when seen from the top.

As has been known, the liner main body portion of the impact-on-the-head absorbing liner 21 shown in FIGS. 2 and 3 and the liner main body portions 25 (see FIGS. 4 to 6) of the impact-on-the-chin-and-cheek absorbing liner 23 can be made of a material with appropriate rigidity and plasticity such as foamed polystyrene or another foamed synthetic resin. As has been known, the backing cover 22 for the head can be made of a combination of sheet materials such as woven fabric or porous unwoven fabric formed by laminating layers, having appropriate shapes and made of a flexible elastic material such as urethane foam or another synthetic resin, on a surface (i.e., the outer surface) which opposes the impact-on-the-head absorbing liner 21, or two side surfaces.

The backing cover 22 for the head shown in FIGS. 2 and 3 can be partially attached to the inner surface of the impact-on-the-head absorbing liner 21 by adhesion with an adhesive or a double-sided tape, or the like. When necessary, the lower end portion of the backing cover 22 for the head can be attached to the outer shell 11 and impact-on-the-head absorbing liner 21 using an engaging member 26 having a substantially U-shaped section, as shown in FIGS. 2 and 3. More specifically, one end (that is, one upright portion) of the engaging member 26 having the substantially U-shaped section is attached to the lower end portion of the backing cover 22 for the head by sewing, adhesion with an adhesive or a double-sided tape, or the like. The other end portion (that is, the other upright portion) of the engaging member 26 having the substantially U-shaped section is inserted between the outer shell 11 and impact-on-the-head absorbing liner 21. During this insertion, the above-described end portion of the engaging member 26 can be attached to the inner surface of the outer shell 11 and/or the outer surface of the impact-on-the-head absorbing liner 21 by adhesion with an adhesive or a double-sided tape, or the like. When necessary, the intermediate portion of the engaging member 26 can be attached to the lower surface of the impact-on-the-head absorbing liner 21 by adhesion with an adhesive or a double-sided tape, or the like.

The pair of left and right blockish inside pads 24 for the cheeks shown in FIG. 2 is symmetrical to each other. Hence, in the following description, the blockish inside pad 24 for the right cheek will be described in detail with reference to FIG. 2, and a detailed description on the blockish inside pad 24 for the left cheek will be omitted. More specifically, as shown in FIG. 2, the blockish inside pad 24 for the right cheek has a notch 31 to exclude an ear region corresponding to the right ear of the wearer. Accordingly, the inside pad 24 has a shape corresponding to the right cheek and its vicinity (excluding the right ear) of the wearer. The right chin strap 6 is inserted in the notch 31. As has been known, the inside pad 24 can be formed of a thick plate-like cushion member (not shown) which is formed of one or a plurality of flexible elastic members such as urethane form or another synthetic resin, and a bag-like member 32 which covers the cushion member substantially entirely like a bag.

The pair of left and right liner main body portions 25 of the impact-on-the-chin-and-cheek absorbing liner 23 shown in FIGS. 2 and 3 is symmetrical to each other. The pair of left and right sheet-like backing plates 33 shown in FIGS. 2 and 6 has such shapes that they back only those cheek regions of the pair of left and right liner main body portions 25 which substantially oppose the cheeks of the wearer. The substantially central sheet-like backing plate 28 backs the chin regions of the pair of left and right liner main body portions 25 which substantially oppose the chin of the wearer. The material and thickness of the pair of left and right sheet-like backing plates 33 and substantially central sheet-like backing plate 28 can be substantially identical to those of the pair of left and right sheet-like backing plates that are used in the conventional full-face-type helmet to support the blockish inside pads 24 for the cheeks.

Figure 4:
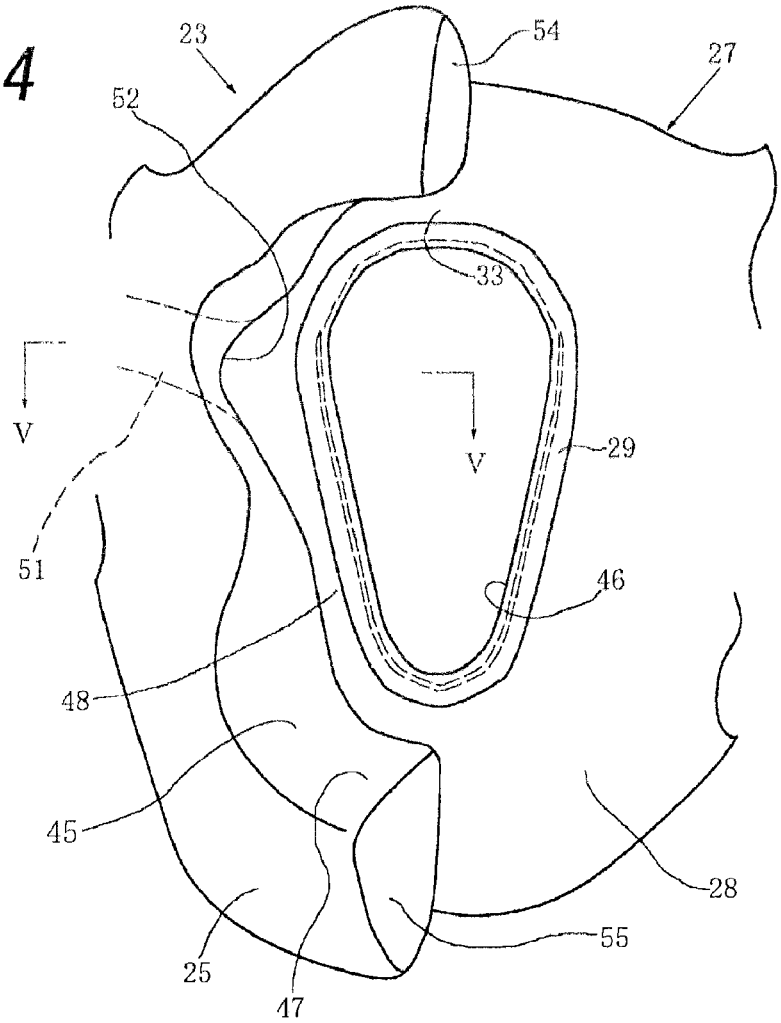
FIG. 4 is a perspective view, seen from above the obliquely front portion of the right side, of the front side portion of the impact-on-the-chin-and-cheek absorbing liner shown in FIG. 2, from which the left liner main body portion is omitted.
Figure 5:
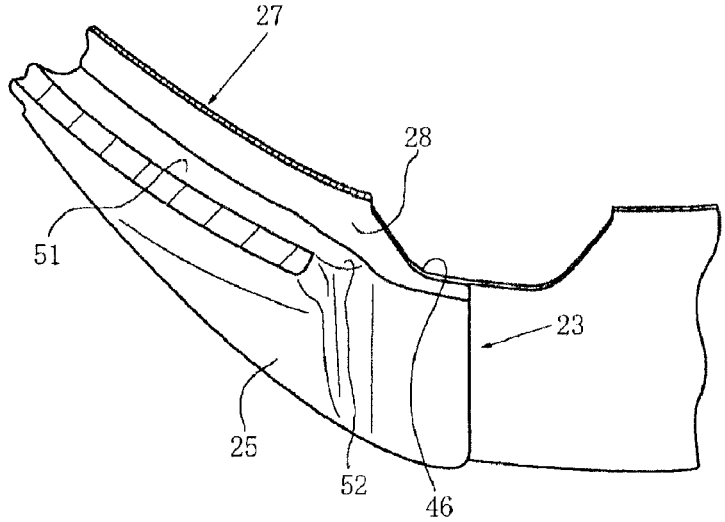
FIG. 5 is a sectional view taken along the line V-V of FIG. 4 in which a ventilation rim member is omitted.
Figure 6:
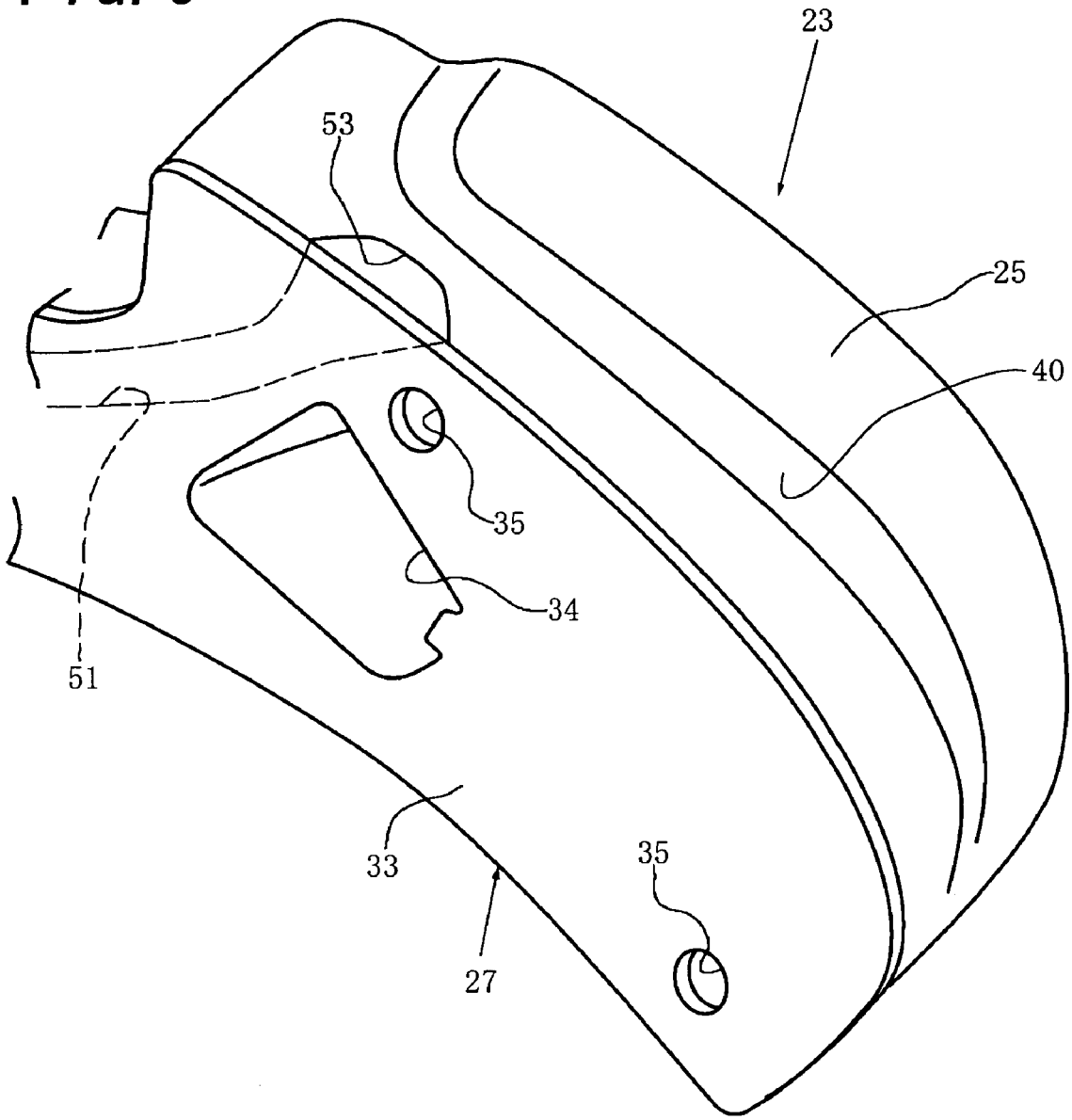
FIG. 6 is a perspective view, seen from above the obliquely rear portion of the right side, of the rear side portion of the impact-on-the-chin-and-cheek absorbing liner shown in FIG. 2.

More specifically, each of the pair of left and right sheet-like backing plates 33 and substantially central sheet-like backing plate 28 can be formed by molding an elastic, preferably non-permeable thin soft sheet material made of polyethylene, another soft synthetic resin, or the like into an appropriate shape. The average thickness of each of the pair of left and right sheet-like backing plates 33 and substantially central sheet-like backing plate 28 shown in FIGS. 4 to 6 is about 1 mm. According to the present invention, from the viewpoint of practice, generally, the average thickness of each of the pair of left and right sheet-like backing plates 33 and substantially central sheet-like backing plate 28 falls preferably within a range of 0.25 mm to 4 mm, more preferably within a range of 0.5 mm to 2 mm, and most preferably within a range of 0.75 mm to 1.4 mm. Each of the sheet-like backing plates 33 and 28 having such material and thickness is poorly flexible but is formed as a self-standing elastic sheet that can hold a predetermined shape itself.

As shown in FIGS. 2 and 6, openings 34 to insert the corresponding chin straps 6 therethrough are formed at substantially the central portions of the cheek regions of the pair of left and right sheet-like backing plates 33 which substantially oppose the cheeks of the wearer. An appropriate number of female portions (that is, female hooks) 35 of round hooks which form engaging holes are provided to the cheek region of each of the pair of left and right sheet-like backing plates 33. The female hooks 35 preferably include a plurality of (three in the embodiment shown in the drawings) female hooks 35. The plurality of female hooks 35 are preferably arranged spaced apart from each other to form appropriate angles, thus substantially surrounding the corresponding opening 34. Openings 36 to insert the corresponding chin straps 6 therethrough are formed in the pair of left and right liner main body portions 25 of the impact-on-the-chin-and-cheek absorbing liner 23, as shown in FIG. 3, to substantially correspond to the openings 34 of the pair of left and right sheet-like backing plates 33. Referring to FIG. 6, reference numeral 40 denotes a step which is formed at the upper end portion of the impact-on-the-chin-and-cheek absorbing liner 23 so as to engage with a step 39 (see FIG. 3) formed at the lower end portion of the impact-on-the-head absorbing liner 21.

As shown in FIG. 2, an appropriate number of male portions (that is, male hooks) 37 of round hooks which form engaging projections are provided to the outer surface of each of the pair of left and right blockish inside pad 24 for the cheeks. The male hooks 37 preferably include a plurality of male hooks 37, and are arranged to substantially correspond to the female hooks 35 of each of the pair of left and right sheet-like backing plates 33. Hence, in the embodiment shown in the drawings, three male hooks 37 are arranged spaced apart from each other to form appropriate angles, thus substantially surrounding the corresponding opening 34. When the male hooks 37 are engaged with the female hooks 35 by pressing through concave/convex engagement (in other words, by the round hooks consisting of the female hooks 35 and male hooks 37), the pair of blockish inside pads 24 for the left and right cheeks are detachably attached to the impact-on-the-chin-and-cheek absorbing liner 23 (in other words, the sheet-like backing plate 27, and hence, the pair of left and right sheet-like backing plates 33). As has been known, the pair of left and right blockish inside pads 24 for the cheeks can be provided with sheet-type inserting portions (not shown) along the lower end portions of the inside pads 24. When the inserting portions are inserted between the outer shell 11 and impact-on-the-chin-and-cheek absorbing liner 23, the lower end portions of the pair of left and right blockish inside pad 24 for the cheeks can be detachably attached to the head protecting body 2.

As shown in FIGS. 1 to 3, the head protecting body 2 is provided with a chin ventilator mechanism 41 to substantially correspond to the chin region of the backing member 16 for the chin and cheek. When necessary, the head protecting body 2 may be provided with a vertex ventilator mechanism (not shown) substantially corresponding to the vertex region and its vicinity of the backing member 15 for the head, a head rear side ventilator mechanism (not shown) substantially corresponding to the back head region and its vicinity and/or the rear portion and its vicinity of the vertex region of the head backing member 15, or any other ventilator mechanism (not shown). The chin ventilator mechanism 41 will be described in detail in the following "(2) Specific Description on Ventilation System".

(2) Specific Description on Ventilation System

As shown in FIGS. 1 to 3, the chin ventilator mechanism 41 comprises a vent port forming member 42 and, when necessary, a shutter member (not shown). Each of the two types of head ventilator constituent members can be made of a material having appropriate elasticity and appropriate rigidity, e.g., polycarbonate, polyacetal, ABS, nylon, or another synthetic resin. The vent port forming member 42 has an appropriate number of vent ports (a total of four, upper, lower, left and right substantially circular vent ports in the embodiment shown in the drawings) 43 each having a substantially circular shape, a slit shape, or another shape.

As shown in FIGS. 2 and 3, a first ventilation opening 44 is formed at substantially the center of the front surface of the outer shell 11. The vent port forming member 42 is attached to the outer surface of the outer shell 11 by adhesion with an adhesive or a double-sided tape, or the like to cover the first ventilation opening 44 from outside the outer shell 11. As has been known, the shutter member can be attached reciprocally, e.g., linearly reciprocally or reciprocally pivotally, to the vent port forming member 42 and/or the outer shell 11 to be able to open/close the vent port 43 on the inner surface of the vent port forming member 42. The shutter member can be directly or indirectly provided with a tap (not shown) to be held by the wearer or the like with a hand in order to reciprocally move the shutter member.

The front end portions of the pair of left and right liner main body portions 25 of the impact-on-the-chin-and-cheek absorbing liner 23 shown in FIGS. 2 and 3 are substantially abutted against each other on the inner surface at substantially the central portion of the front surface of the outer shell 11 so as to be in a substantially abutting state. As shown in FIG. 4, a missing portion (in other words, a recess which hollows in the planar direction) 47 is formed in each front end to run from the abutting surface toward the rear end side and extend substantially in the direction of thickness. Thus, a second ventilation opening (i.e., a through hole) comprising the pair of left and right missing portions 47 is formed in the abutting portion where the front end portions of the pair of left and right liner main body portions 25 are substantially abutted against each other. As shown in FIG. 4, a third ventilation opening (i.e., a through hole) 46 substantially opposing the second ventilation opening 47 is formed in substantially the central portion of the substantially central sheet-like backing plate 28. The third ventilation opening 46 can comprise the central opening of a ventilation hole rim member 29 which has a substantially U-shaped section and is attached to substantially throughout the entire circumference of the opening of the sheet-like backing plate 28. The ventilation hole rim member 29 can be made of a flexible elastic material such as synthetic rubber or the like.

The third ventilation opening 46 shown in FIGS. 4 and 5 is much smaller than the second ventilation opening formed of the pair of left and right missing portions 45. The third ventilation opening 46 has such a shape that it is not closed, even partially, by the pair of left and right liner main body portions 25. The front end portions of the pair of left and right liner main body portions 25 may slightly form a gap between them. Accordingly, the second ventilation opening 47 need not form a closed loop but may form an open loop. The number of third ventilation openings 46 and/or that of second ventilation openings 47 need not be one. A plurality of ventilation openings 46 may be formed in the substantially central sheet-like backing plate 28, or a plurality of missing portions 45 may be formed in each of the pair of left and right liner main body portions 25, to provide a plurality of third ventilation opening 46 and/or a plurality of second ventilation openings 47.

As shown in FIGS. 2 to 6, a ventilation ridge groove (i.e., a laesura) 51 having a section (more accurately, a section in a direction perpendicular to the longitudinal direction) that forms a substantially opened loop is formed in the inner surface of each of the pair of left and right liner main body portions 25 of the impact-on-the-chin-and-cheek absorbing liner 23. The start ends of the ventilation ridge grooves 51 continue to the respective missing portions (in other words, the second ventilation opening) 45 which are formed in the front end portions of the pair of left and right liner main body portions 25. Accordingly, the ventilation ridge grooves (in other words, air passages) 51 directly communicate with the second ventilation opening 47. The ventilation ridge grooves 51 extend from the start ends substantially backward, bend substantially upward substantially arcuately, then extend substantially upward and terminate in regions (that is, the end faces) comprising the upper end portions and their vicinities of the pair of left and right liner main body portions 25. Therefore, an air passage comprising the ventilation ridge grooves 51 and having substantially closed-loop-like section is formed between the pair of left and right liner main body portions 25, and the substantially central sheet-like backing plate 28 and pair of left and right sheet-like backing plates 33 which are attached to the inner surfaces of the pair of left and right liner main body portions 25.

As shown in FIGS. 2 and 3, the ventilation ridge grooves (in other words, air passages) 51 extend from a region comprising the chin region and its vicinity of the head protecting body 2 substantially opposing the chin of the wearer through the cheek regions of the head protecting body 2 substantially opposing the cheeks of the wearer to regions comprising the left and right side head regions and their vicinities of the head protecting body 2 substantially opposing the two, left and right of the side heads of the wearer. A start end portion 52 (and, depending on the case, a terminal end portion 53) of each ventilation ridge groove (in other words, air passage) 51 can be formed to gradually widen substantially into a trumpet shape, when seen from the front, from the terminal end side to the start end (and, depending on the case, from the start end side to the terminal end). The width, depth, sectional area and the like of that portion (that is, the main part) of the ventilation ridge groove (in other words, air passage) 51 excluding the substantially trumpet-shaped start end portion 52 (and, depending on the case, the substantially trumpet-shaped terminal end portion 53) can be substantially equal to those of each of the ventilation ridge grooves and air passages usually provided to the impact absorbing liners 21 and 23.

More specifically, in the embodiment shown in the drawings, the average width, average depth and average sectional area of the main part of the ventilation ridge groove (in other words, air passage) 51 shown in FIGS. 2 to 6 are about 8 mm, about 4 mm and about 25 $mm^2$, respectively. In this respect, from the viewpoint of practice, the present invention generally preferably satisfies the numerical ranges described in the following items (a) to (c). The numerical ranges in parentheses described in the following items (a) to (c) are more preferable numerical ranges which are satisfied in the present invention.

(a) the average width of the main part of the ventilation ridge groove (in other words, air passage) 51 falls within a range of 4 mm to 16 mm (6 mm to 11 mm)

(b) the average depth of the main part of the ventilation ridge groove (in other words, air passage) 51 falls within a range of 2 mm to 8 mm (3 mm to 5.5 mm), and (c) the average sectional area of the main part of the ventilation ridge groove (in other words, air passage) 51 falls within a range of 8 $mm^2$ to 80 $mm^2$ (12 $mm^2$ to 40 $mm^2$).

Regarding the width and sectional area of the start end of the substantially trumpet-shaped start end portion 52 shown in FIG. 4, numerical values obtained by multiplying by four the numerical values described in the above items (a), (c) and the like define the numerical values of the embodiment shown in the drawings, preferable numerical ranges and more preferable numerical ranges. Regarding the depth of the start end, the numerical values described in the above item (b) and the like define the numerical values of the embodiment shown in the drawings, preferable numerical ranges and more preferable numerical ranges. Regarding the width and sectional area of the terminal end of the substantially trumpet-shaped terminal end portion 53 shown in FIG. 6, numerical values obtained by doubling the numerical values described in the above items (a), (c) and the like define the numerical values of the embodiment shown in the drawings, preferable numerical ranges and more preferable numerical ranges. Regarding the depth of the terminal end, the numerical values described in the above item (b) and the like define the numerical values of the embodiment shown in the drawings, preferable numerical ranges and more preferable numerical ranges.

The size (that is, area) of the third ventilation opening 46 (in other words, the central opening of the ventilation hole rim member 29) shown in FIG. 4 is about 11 $cm^2$ in the case of the embodiment shown in the drawings. The size (that is, area) of the second ventilation opening 47 in the outer surfaces of the liner main body portions 25 of the impact-on-the-chin-and-cheek absorbing liner 23 are about 26 $cm^2$ in the case of the embodiment shown in the drawings. In other words, the area of the missing portion 45 in the outer surface (that is, the outer shell 11 side surface) of each of the pair of left and right liner main body portions 25 is about 13 $cm^2$. The size (that is, area) of the second ventilation opening 47 in the inner surfaces (that is, the sheet-like backing plate 27 side surfaces) of the liner main body portions 25 is about 22 $cm^2$ in the case of the embodiment shown in the drawings. In other words, the area of the missing portion 45 in the inner surface of each of the pair of left and right liner main body portions 25 is about 11 $cm^2$.

The second ventilation opening 47 shown in FIG. 4 is curved from the outer surface of the liner main body portion 25 toward the inner side (in other words, from the front surface to the rear surface side). Accordingly, although the second ventilation openings 47 merely serve as through holes, their area in the outer surfaces of the liner main body portions 25 is larger than their area in the inner surfaces of the liner main body portions 25 by about 4 $cm^2$. In other words, the value obtained by subtracting the area of the respective missing portion 47 in the inner surface of each of the pair of left and right liner main body portions 25 from the area of the missing portion 47 in the outer surface of each of the pair of left and right liner main body portions 25 is about 2 $cm^2$. Also, the size (that is, area) of the second ventilation opening 47 in the inner surfaces of the liner main body portions 25 is larger than the size (that is, area) of the first ventilation opening 46 by about 11 $cm^2$. In other words, that substantially ring-like (in other words, substantially closed-loop-like) projection 48 (see FIG. 4) of the substantially central sheet-like backing plate 28 (in other words, the three-piece sheet-like backing plate 27) which projects toward the second ventilation opening 47 (that is, the central portion side of the front surface of the helmet 1) on the inner surfaces of the pair of left and right liner main body portions 25 with a substantially equal width has an area of about 5.5 $cm^2$. Therefore, the projection 48 overhangs from the second ventilation opening 47 and faces the opening 47, as shown in FIG. 4, and its average projection width is about 6 mm.

Regarding the above respects, from the viewpoint of practice, the present invention generally preferably satisfies the numerical ranges described in the following items (d) to (j). The numerical ranges in parentheses described in the following items (d) to (j) are more preferable numerical ranges which are satisfied in the present invention.

(d) the area of the third ventilation opening 46 (when a plurality of openings 46 are provided, their total area) falls within a range of 3 $cm^2$ to 40 $cm^2$ (6 $cm^2$ to 20 $cm^2$), (e) the area of the second ventilation opening 47 (when a plurality of ventilation openings 47 are provided, their total area) in the outer surfaces of the liner main body portions 25 falls within a range of 8 $cm^2$ to 100 $cm^2$ (16 $cm^2$ to 46 $cm^2$), and the area of each missing portion 45 (when a plurality of missing portions 45 are provided with each liner main body portion 25, their total area) in the outer surface of each of the pair of right and left liner main body portions 25 falls within a range of 4 $cm^2$ to 50 $cm^2$ (8 $cm^2$ to 23 $cm^2$), (f) the area of the second ventilation opening 47 (when a plurality of openings 47 are provided, their total area) in the inner surfaces of the liner main body portions 25 falls within a range of 6 $cm^2$ to 80 $cm^2$ (12 $cm^2$ to 38 $cm^2$), and the area of each missing portion 45 (when a plurality of missing portions 45 are provided with each liner main body portion 25, their total area) in the inner surface of each of the pair of right and left liner main body portions 25 falls within a range of 3 $cm^2$ to 40 $cm^2$ (6 $cm^2$ to 19 $cm^2$), (g) the value obtained by subtracting the area described in the above item (f) of the second ventilation opening 47 in the inner surfaces of the liner main body portions 25 from the area described in the above item (e) of the second ventilation opening 47 in the outer surfaces of the liner main body portions 25 falls within a range of 2 $cm^2$ to 20 $cm^2$ (4 $cm^2$ to 8 $cm^2$), and the value obtained by subtracting the area described in the above item (f) of each missing portion 47 in the outer surface of each of the pair of left and right liner main body portions 25 from the area described in the above item (d) of each missing portion 47 in the outer surface of each of the pair of left and right liner main body portions 25 falls within a range of 1 $cm^2$ to 10 $cm^2$ (2 $cm^2$ to 4 $cm^2$), (h) the value obtained by subtracting the area described in the above item (d) of the third ventilation opening 46 from the area described in the above item (e) of the second ventilation opening 47 in the inner surfaces of the liner main body portions 25 falls within a range of 3 $cm^2$ to 40 $cm^2$ (6 $cm^2$ to 18 $cm^2$), (i) the area of that projection of the substantially central sheet-like backing plate 28 which projects toward the second ventilation opening 47 in the inner surfaces of the pair of left and right liner main body portions 25 with a substantially equal width or the like falls within a range of 1.5 $cm^2$ to 20 $cm^2$ (3 $cm^2$ to 9 $cm^2$), and (j) the average projection width of that projection 48 of the substantially central sheet-like backing plate 28 which projects toward the second ventilation opening 47 in the inner surfaces of the pair of left and right liner main body portions 25 falls within a range of 3 mm to 12 mm (4.5 mm to 8 mm).

The areas and projection width described in the above items (d) to (j) and the like are values obtained when the third and second ventilation openings 46 and 47 (including the missing portions 45) and projection 48 shown in FIG. 4 are seen straight opposite from the front. The areas and projection width described in the above items (d) and (j) and the like are values respectively obtained by calculation without including the ventilation ridge groove 51 in the third and second ventilation openings 46 and 47 (including the missing portions 45 shown in FIG. 4.

As described above, the front end portions of the pair of left and right liner main body portions 25 of the impact-on-the-chin-and-cheek absorbing liner 23 shown in FIGS. 2 to 6 are substantially abutted against each other on the inner surface at substantially the center of the front surface of the outer shell 11 to be in a substantially abutting state. The liner main body portions 25 can respectively comprise a pair of upper and lower substantially flat front end faces 54 and 55, as shown in FIGS. 2 to 4. Hence, during the abutment described above, the respective pair of upper and lower front end faces 54 and 55 of each of the pair of left and right liner main body portions 25 can be connected to each other, when necessary, by adhesion with an adhesive or a double-sided tape, or the like.

Of the impact-on-the-chin-and-cheek absorbing liner 23 shown in FIGS. 2 to 6, a region including the substantially central sheet-like backing plate 28 and its vicinity can be partly or entirely covered with a flexible and preferably non-permeable sheet material such as synthetic leather. Such a covering sheet material (not shown) can also cover the inner surface of the liner 23 throughout substantially the entire portion between the pair of left and right inside pads 24. If the upper and lower end portions of the covering sheet material are folded back at the upper and lower ends of the liner 23 to the outer surface of the liner 23, the region including the upper end portion and its vicinity of the liner 23 and the region including the lower end portion and its vicinity of the liner 23 can also be simultaneously covered partly or entirely. As the covering sheet material, one is preferable which has a ventilation opening substantially corresponding to the third ventilation opening 46 formed in the substantially central sheet-like backing plate 28 and in which the third ventilation opening 46 is not closed by the covering sheet material even partly. More specifically, the pair of left and right impact-on-the-chin-and-cheek absorbing liners 23 can be covered with the covering sheet material after attaching the two, left and right end portions of the covering sheet material to the front end portions of the pair of left and right sheet-like backing plates 33 by sewing, adhesion with an adhesive or a double-sided tape, or the like. In this case, the inner surface of the substantially central sheet-like backing plate 28 can be covered with the covering sheet material substantially entirely.

A dustproof sheet made of a mesh-like dustproof material such as permeable, dustproof urethane foam can be arranged on the inner surface (more specifically, a portion between the inner surface of the air supply port forming member 42 and the outer surface of the substantially central sheet-like backing plate 28) of the air supply port forming member 42 shown in FIGS. 1 to 3. When necessary, such a dustproof sheet can be arranged in front of the start end of each of the pair of left and right air passages 51. As shown in FIGS. 2 and 3, several ventilation ridge grooves 56 and 57 to respectively form air passages can be formed in the inner surface of the backing cover 22 for the head (that is, the surface on the side of the space 60, which accommodates the wearer's head), substantially symmetrically with respect to the cover 22. One end (that is, the lower end) 58 of each of the pair of left and right ventilation ridge grooves (that is, the air passages) 57, of the ventilation ridge grooves 56 and 57, substantially opposes the terminal end 53 of the corresponding one of the pair of left and right ventilation ridge grooves 51 respectively formed in the impact-on-the-chin-and-cheek absorbing liners 23. At the respective lower end portions 58 of the pair of left and right ventilation ridge grooves 57, those portions of the impact-on-the-head absorbing liner 21 which oppose the lower end portions 58 are chamfered to form chamfered portions 61. Accordingly, one set of left and right air currents that have flown through the pair of left and right ventilation ridge grooves 51 until their terminal end portions 53 can flow well into the respective lower end portions 58 of the pair of left and right ventilation ridge grooves 57 due to the presence of the chamfered portions 61. Depending on the case, the set of left and right air currents can flow well into the portion between the impact-on-the-head absorbing liner 21 and backing cover 22 for the head.

The ventilation system of the full-face-type helmet 1 having the above arrangement shown in FIGS. 1 to 6 can operate in the following manner.

More specifically, when the wearer wearing the full-face-type helmet 1 drives off-road or the like on a motorcycle, the external air (that is, the outer air) relatively flows into the vent ports (that is, the first ventilation openings) 43 serving as the air supply ports of the air supply port forming member 42 of the chin ventilator mechanism 41 substantially from the front surface. Part of the external air that has passed through the vent ports 43 relatively passes through the second ventilation opening 47 serving as an air supply port formed between the front end portions of the pair of left and right liner main body portions 25, and the third ventilation opening 46 serving as an air supply port formed in the substantially central sheet-like backing plate 28, and relatively flows into a region comprising the chin and its vicinity of the wearer (in other words, a region comprising the mouth and its vicinity).

Another part of the external air that has passed through the vent ports 43 relatively flows into the second ventilation opening 47 and the respective start end portions 52 of the pair of left and right air passages 51 respectively formed in the impact-on-the-chin-and-cheek absorbing liners 23. As shown in FIG. 4, note that the substantially central sheet-like backing plate 28 (in other words, the sheet-like backing plate 27) has the substantially ring-like projection 48 serving as a deflector or baffle which faces the outer periphery of the second ventilation opening 47. Therefore, part of the external air which is to relatively flow into the ventilation opening 47 is blocked by the substantially ring-like projection 48 and inhibited from relatively flowing into the ventilation opening 47. Consequently, the external air can relatively flow readily into the respective start end portions 52 of the pair of left and right air passages 51.

The set of left and right external air currents (that is, air currents) relatively flowing into the respective start end portions 52 of the pair of left and right air passages 51 respectively flow through the pair of left and right air passages 51 shown in FIGS. 2 to 4 backward until their terminal end portions 53. The set of right and left air currents then relatively flow from the respective terminal ends of the pair of left and right air passages 51 toward the respective lower end portions 58 of the pair of left and right ventilation ridge grooves (in other words, air passages) 57. Furthermore, the set of left and right air currents further flow relatively between the wearer's head and the pair of left and right ventilation ridge grooves 57 along the pair of left and right ventilation ridge grooves 57.

Respective upper end portions 59 of the pair of left and right ventilation ridge grooves 57 are continuous to the another pair of left and right ventilation ridge grooves (in other words, air passages) 56. Hence, the set of left and right air currents relatively flowing along the pair of left and right ventilation ridge grooves 57 from their lower end portions 58 toward their upper end portions 59 mix with another set of left and right air currents relatively flowing in the pair of left and right ventilation ridge grooves 56 backward from the front portions. The mixed air currents then relatively flow in the pair of left and right ventilation ridge grooves 57 backward. The set of left and right air currents, another set of left and right air currents, and the set of left and right mixed air currents partly or entirely diffuse in a head accommodating space 60, when flowing in the ventilation ridge grooves 56 and 57, and are discharged outside through the exhaust hole of the head rear-side ventilator mechanism (not shown), the lower end of the head accommodating space 60, the vent hole 10 and the like. In the above description on the operation of the ventilation system, a description on the operation of ventilator mechanisms (not shown) (that is, the vertex ventilator mechanism, head rear-side ventilator mechanism and the like) other than the chin ventilator mechanism 41, and on air passages (not shown) related to these ventilator mechanisms are omitted.

Having described a specific preferred embodiment of this invention with reference to the accompanying drawings, it is to be understood that the invention is not limited to that precise embodiment, and that various changes and modifications may be effected therein by one skilled in the art without departing from the scope or spirit of the invention as defined in the appended claims.

For example, in the embodiment described above, the present invention is applied to the full-face-type helmet 1 in which the chin cover cannot be raised. However, the present invention can also be applied to a full-face-type helmet serving also as a jet-type helmet in which the chin cover can be raised.

In the embodiment described above, the liner main body portion of the impact-on-the-chin-and-cheek absorbing liner 23 comprises the left liner main body portion 25 and right liner main body portion 25. Alternatively, a liner main body portion in which the left liner main body portion 25 and right liner main body portion 25 are integrally molded can be used instead.

In the embodiment described above, the sheet-like backing plate 27 which is substantially arcuate when seen from the top comprises three pieces, i.e., the pair of left and right sheet-like backing plates 33 and the substantially central sheet-like backing plate 28. Alternatively, the three sheet-like backing plates 33 and 28 may be integrally molded to be sequentially continuous so the sheet-like backing plate 27 comprises one piece. Either one of the pair of left and right sheet-like backing plates 33, and the substantially central sheet-like backing plate 28 may be integrally molded so the sheet-like backing plate 27 comprises two pieces. The sheet-like backing plate 27 which is substantially arcuate when seen from the top may comprise only a pair of left and right sheet-like backing plates, in the same manner as in the case of the pair of left and right liner main body portions 25. In this case, missing portions may be formed respectively in the abutting portions of the pair of left and right sheet-like backing plates, so the pair of left and right missing portions form the third ventilation opening 46.

In the embodiment described above, the pair of left and right missing portions 47 respectively formed in the pair of left and right liner main body portions 25 form the second ventilation opening 47 in the liner main body portions 25. Alternatively, either one of the pair of left and right liner main body portions 25 may be formed long while the remaining one may be formed short, and a closed-loop-like ventilation opening similar to the second ventilation opening 47 may be formed in only the long liner main body portion 25.

In the embodiment described above, the third ventilation opening 46 is formed in the sheet-like backing plate 27. If external air need not flow into the third ventilation opening 46 toward the wearer's chin, the third ventilation opening 46 can be eliminated to form a closed surface. If a shutter (not shown) which opens/closes the third ventilation opening 46 is provided, the third ventilation opening 46 can be opened/closed, and its opening proportion can be changed.

In the embodiment described above, the channel spaces that respectively form the pair of left and right air passages to be respectively formed in the impact-on-the-chin-and-cheek absorbing liner 23 comprise only the pair of left and right ventilation ridge grooves 51 respectively formed in the pair of left and right liner main body portions 25. Alternatively, if a pair of left and right second ventilation ridge grooves are also formed in the sheet-like backing plate 27 to respectively oppose the pair of left and right ventilation ridge grooves 51, the pair of left and right ventilation ridge grooves 51 and the pair of left and right second ventilation ridge grooves can form a pair of left and right air passages. In place of the second ventilation ridge grooves, projections that project toward the ventilation ridge grooves 51 can be formed on the sheet-like backing plate 27 along the air passages 51 partly or entirely. In any of these cases, one or a plurality of pores can be formed in the sheet-like backing plate 27 so as to allow part of the air current flowing through the air channels 51 to flow in toward the inner side of the sheet-like backing plate 27.

In the embodiment described above, the male hooks 37 are formed on the outer surfaces of the pair of left and right inside pads 24, and the female hooks 35 are formed on the sheet-like backing plate 27. Alternatively, one or a plurality of, or all the female hooks 35 can be replaced with male hooks 37, and the original male hooks 37 that corresponded to the replacing female hooks 35 can be replaced with female hooks 35. Attaching tools to attach the pair of left and right inside pads 24 to the sheet-like backing plate 27 need not be round hooks each comprising a female hook 35 and male hook 37, but can be a surface fastener or the like.

The invention claimed is:

1. A full-face-type helmet comprising:

an outer shell having a first ventilation opening in a chin region substantially opposing the chin of a helmet wearer, an impact-on-the-chin-and-cheek absorbing liner disposed inside said outer shell, and a blockish inside pad for the cheek which is attached to an inner surface of said impact-on-the-chin-and-cheek absorbing liner;

said impact-on-the-chin-and-cheek absorbing liner comprising a liner main body portion and a sheet-like backing plate which is arranged on an inner surface of said liner main body portion and to which said blockish inside pad for the cheek is attached;

said liner main body portion comprising a second ventilation opening substantially opposing said first ventilation opening; and said liner main body portion further comprising a ventilation ridge groove which is formed in said inner surface of said liner main body portion and communicates with said second ventilation opening;

wherein said sheet-like backing plate comprises a third ventilation opening substantially opposing said second ventilation opening;

wherein said sheet-like backing plate comprises a projection which is formed of at least part of a peripheral portion of said third ventilation opening and faces said second ventilation opening;

wherein said projection forms a substantially ring-like shape rising from said peripheral portion substantially entirely of said third ventilation opening;

wherein said sheet-like backing plate comprises a pair of left and right sheet-like backing plates and a substantially central sheet-like backing plate interposed between said pair of left and right sheet-like backing plates; and said third ventilation opening is formed in said substantially central sheet-like backing plate.

2. A helmet according to claim 1, wherein said projection is formed on said substantially central sheet-like backing plate.

3. A helmet according to claim 1, wherein said ventilation ridge groove has a start end facing said second ventilation opening and a terminal end which is formed in an end face of said liner main body portion in a region including an upper end portion and its vicinity of said liner main body portion.

4. A helmet according to claim 3, wherein said ventilation ridge groove extends from said start end substantially backward, bends substantially upward substantially arcuately, then extends substantially upward and reaches said terminal end which is present in a region including a side head region and its vicinity of said impact-on-the-chin-and-cheek absorbing liner substantially opposing a side head part of the helmet wearer.

5. A full-face-type helmet comprising:

an outer shell having a first ventilation opening in a chin region substantially opposing the chin of a helmet wearer, an impact-on-the-chin-and-cheek absorbing liner disposed inside said outer shell, and a blockish inside pad for the cheek which is attached to an inner surface of said impact-on-the-chin-and-cheek absorbing liner;

said impact-on-the-chin-and-cheek absorbing liner comprising a liner main body portion and a sheet-like backing plate which is arranged on an inner surface of said liner main body portion and to which said blockish inside pad for the cheek is attached;

said liner main body portion comprising a second ventilation opening substantially opposing said first ventilation opening; and said liner main body portion further comprising a ventilation ridge groove which is formed in said inner surface of said liner main body portion and communicates with said second ventilation opening;

wherein a liner main body portion of said impact-on-the-chin-and-cheek absorbing liner comprises a pair of left and right liner main body portions; and said second ventilation opening is formed by abutting a first missing portion formed in said left liner main body portion and a second missing portion formed in said right liner main body portion to be in a substantially abutting state.

6. A helmet according to claim 5, wherein said ventilation ridge groove has a start end facing said second ventilation opening and a terminal end which is formed in an end face of said liner main body portion in a region including an upper end portion and its vicinity of said liner main body portion.

7. A helmet according to claim 6, wherein said ventilation ridge groove extends from said start end substantially backward, bends substantially upward substantially arcuately, then extends substantially upward and reaches said terminal end which is present in a region including a side head region and its vicinity of said impact-on-the-chin-and-cheek absorbing liner substantially opposing a side head part of the helmet wearer.

* * * * *